US005116243A

United States Patent [19]

Wills

[11] Patent Number: 5,116,243

[45] Date of Patent: May 26, 1992

[54] CARPET DYE FIXATION METHOD AND APPARATUS

[75] Inventor: Leslie J. Wills, Lidcombe, Australia

[73] Assignee: Scientific and Industrial Research Organisation, Australia

[21] Appl. No.: 602,325

[22] PCT Filed: Jun. 2, 1989

[86] PCT No.: PCT/AU89/00246

§ 371 Date: Jan. 30, 1991

§ 102(e) Date: Jan. 30, 1991

[87] PCT Pub. No.: WO89/12136

PCT Pub. Date: Dec. 14, 1989

[30] Foreign Application Priority Data

Jun. 2, 1988 [AU] Australia ..... PI8578

[51] Int. Cl.[5] ..... D06B 5/24

[52] U.S. Cl. ..... 8/149.2; 8/150; 8/933; 34/9; 34/41; 34/95; 68/5 C; 219/229

[58] Field of Search ..... 8/148, 149.2, 150, 484, 8/933; 68/5 R, 5 A, 5 B, 5 C, 6, 200; 26/2 R, 6; 28/159, 179, 184, 214; 132/118; 219/229; 34/9, 40, 41, 95, 143, 144; 156/72, 252, 253, 513, 514, 581; 101/30

[56] References Cited

U.S. PATENT DOCUMENTS

| | | | |
|---|---|---|---|
| 1,533,416 | 4/1925 | Holchin | 219/229 X |
| 1,789,869 | 1/1931 | Herrmann | 26/2 R X |
| 2,635,672 | 4/1953 | Rumsey Jr. | 219/229 X |
| 3,013,930 | 12/1961 | Serbin | 156/581 |
| 3,456,581 | 7/1969 | Zuber | 34/144 X |
| 3,555,695 | 1/1971 | Dunn, Jr. | 34/41 X |
| 3,619,103 | 11/1971 | Williams et al. | 8/484 |
| 4,190,100 | 2/1980 | Wallace . | |
| 4,655,784 | 4/1987 | Rahman | 8/148 |
| 4,974,431 | 12/1990 | Kyle | 68/5 C |

FOREIGN PATENT DOCUMENTS

| | | | |
|---|---|---|---|
| 960474 | 1/1975 | Canada . | |
| 1308012 | 9/1962 | France | 219/229 |

*Primary Examiner*—Philip R. Coe

*Attorney, Agent, or Firm*—Sughrue, Mion, Zinn, Macpeak & Seas

[57] ABSTRACT

Liquid dye deposited on the pile of a carpet tile can be fixed by inserting an array of heated pins into the pile. The pins, mounted on a block, penetrate the tufts of the pile which have liquid dye thereon but do not penetrate the backing of the carpet tile. A heating element to raise the pins to the fixation temperature of from 90° C. to 100° C. is clamped to or located within the block. Preferably, both the block and the pins are made of metal (not necessarily the same metal).

11 Claims, 1 Drawing Sheet

CARPET DYE FIXATION METHOD AND APPARATUS

TECHNICAL FIELD

This invention concerns the rapid heating of, and the fixation of dye that has been applied to, the pile of tufted carpet tiles.

BACKGROUND

In the production of carpet tiles, it is common practice to apply a liquid dye solution to the surface pile of the carpet tiles by a printing process. In general, the application ratio is in the range of from 100 percent to 400 percent of the surface pile weight. That is, the dye applied is usually at least equal in weight to the weight of the pile of the carpet, and may be up to four times that weight. Normally the pile is about 4 mm long, and the required penetration of the dye is through about the top two-thirds of the pile. Only in the least densely packed pile is it necessary for the dye to penetrate down to the backing of the carpet (that is the situation where a dye quantity of about four times the weight of the pile has to be applied to it).

In modern production lines, a jet printer applies the dye solution to the carpet tile by means of controlled jets of liquid.

After the printing of the carpet tile, it is usual practice to fix the dyestuff to the surface pile fibres by a heating process. Until now, the heating has been effected using a steaming chamber, in which the carpet tile is raised to a temperature which is in the range of from 90° C. to 100° C. This process raises the temperature of the surface pile, and of the dyestuff contained therein, by the condensation of steam on the surface of the dye and the pile tufts. As a consequence of the condensation, the thermal energy of the latent heat of vaporisation is transferred to those surfaces. This process has the advantage of maintaining the high humidity environment necessary for dye fixation, but it also has a serious drawback. The dye fixation takes a relatively long time, due to the slow rate of conduction of heat through the liquid contained in the surface pile, water being a poor thermal conductor.

Another disadvantage of this steam chamber fixing process is that it is difficult to achieve a uniform temperature at all places in the steaming chamber. Non-uniformity of temperature within the chamber is known to result in a varying percentage of the dyestuff being fixed to the tile, which causes different colour yields between carpet tiles and sometimes an uneven colour yield across a single carpet tile.

Two other, but less commonly used, methods of fixing dyestuff to carpet or carpet tiles use radiant energy and microwave energy, respectively, as a source of heat. The main problem with radiant energy heaters is that it is difficult to generate the amount of energy necessary to raise the temperature quickly in a carpet tile. In addition, using the radiation generators currently available makes it extremely difficult to obtain uniform heating of the surface of the carpet tile, so that uniform dye fixation and colour yield is difficult to achieve.

Microwave heaters can melt the bituminous materials of the backing of some carpet tiles (bituminous materials being ready absorbers of microwave energy). Heating systems utilising focused microwave energy are expensive. They are also difficult to operate to obtain uniform heating over a significant area.

Both the radiant and microwave heating methods also commonly result in the absorption of significant amounts of energy in the backing of the tile, thus giving reduced thermal efficiency and sometimes causing dimensional instability in the backing.

DISCLOSURE OF THE PRESENT INVENTION

It is an object of the present invention to provide a method and apparatus whereby the temperature of the dye used to colour the pile tufts of carpet tiles can be rapidly and efficiently raised to the required dye fixing temperature, and whereby uniform dye fixation and colour yield is obtained without adversely affecting the backing of the carpet tiles.

To achieve this objective, heat is transferred to the dye and to the carpet pile tufts using an array of hot needle-like heat conductors (pins) which are caused to penetrate into the pile of the carpet tile. It has been found that this technique of heat transfer raises the temperature of the dye and pile very rapidly in almost any desired profile or characteristic with respect to time.

Thus according to the present invention, a method of fixation of liquid dye applied to the pile of a carpet tile consisting of a backing material with pile thereon, comprises the steps of:

(a) positioning the carpet tile within a housing having a base and side walls extending from the base, with the backing material of the tile in contact with the base; and (b) moving into the housing a block having a two-dimensional array of heated pins extending from a lower face thereof, until each pin of the array penetrates the pile to a predetermined depth; whereby heat from the pins raises the temperature of the dye on the pile to a temperature sufficient to fix the dye.

Also according to the present invention, apparatus for fixation of liquid dye on the pile of a carpet tile consisting of a backing material with pile thereon comprises:

(a) a carpet tile receiving housing, said housing having a base and side walls extending therefrom;

(b) a thermally conducting block having an upper face and a lower face, said block having dimensions such that it can be moved into said housing;

(c) a two-dimensional array of pins extending from the front face of said block; and (d) a heating element either (i) located within said block or (ii) affixed to said upper face of the block;

Normally both the pins and the block will be of metal. Preferably, the pins are made from a metal which resists attack by a corrosive environment. In addition, it will be normal for the face of the block from which the pins extend to be planar, but that face may be a curved surface, or otherwise shaped, to suit the shape of the surface of the medium to be heated.

These and other features of the present invention (some being optional features) will be referred to in the following description of an embodiment of the present invention, in which reference will be made to the accompanying drawings.

DETAILED DESCRIPTION OF THE ILLUSTRATED EMBODIMENT

Figure 1:
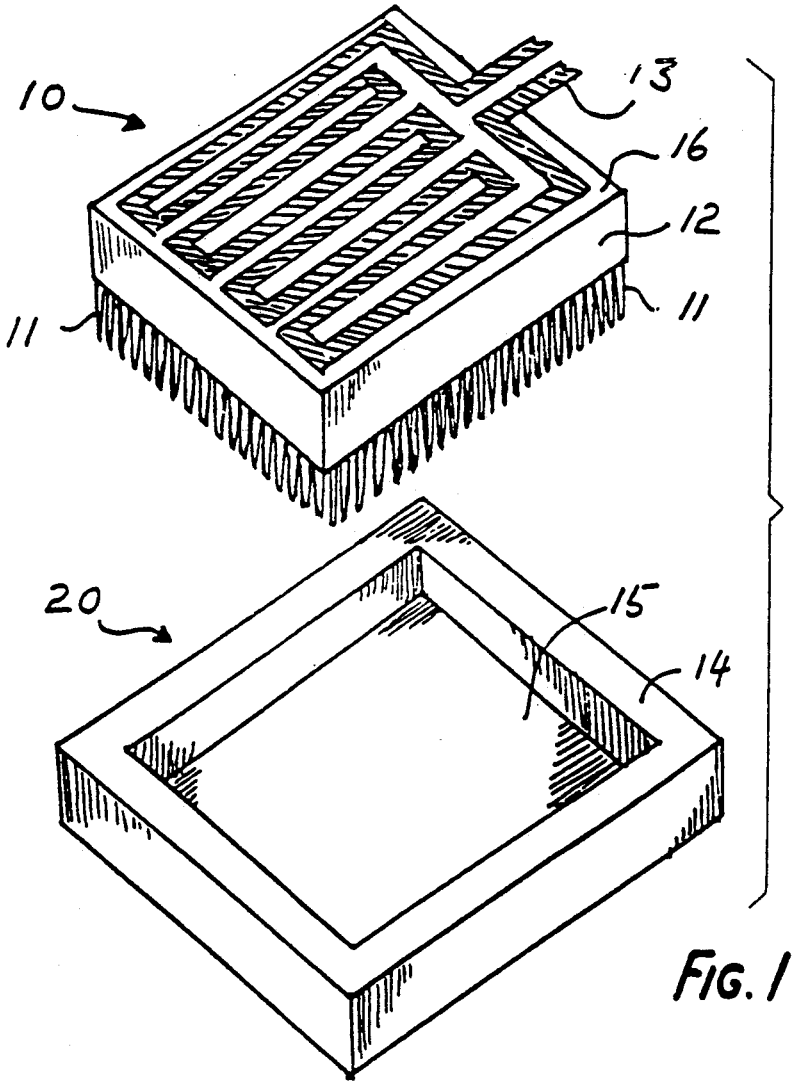
FIG. 1 is a perspective sketch, illustrating (partly schematically) a carpet tile pile heating unit which is constructed in accordance with the present invention.
Figure 2:
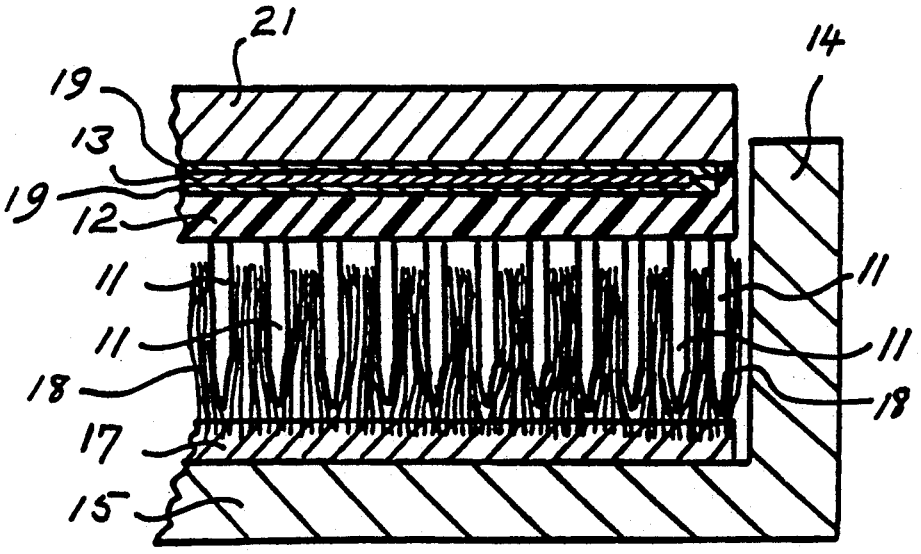
FIG. 2 is a sectional view (not to scale) of part of the unit of FIG. 1, when that unit is being used to fix the dye on the pile of a carpet tile.

Before referring specifically to FIGS. 1 and 2, it should be noted that a detailed evaluation by the present inventor of the printing of carpet tiles has shown that the conditions required to achieve rapid and uniform fixation of the print liquor applied to carpet tiles are: firstly, that the temperature of the print liquor should be raised to the fixation temperature as rapidly and as uniformly as possible; secondly, that the temperature should be held uniform and constant across the tile and between tiles for a pre-determined period of time; and thirdly, that a high humidity should be maintained to assist the transfer of the dyestuff into the fibre and to promote uniform and complete fixation of the dye.

All these conditions are met when the present invention is used.

Referring now to the drawings, the illustrated carpet tile dye fixation unit comprises a heating component 10 and a tile-receiving housing 20. The tile receiving housing, which is preferably made from a thermally insulating material, has a base 15 which has essentially the same dimensions as the carpet tile to be inserted into the housing, and side walls 14. The walls 14 retain the carpet tile or tiles in the required location during dye fixation and also minimise lateral loss of heat during the fixation process.

The heating component of the unit illustrated in the drawings comprises a block 12 from which the pins of a regular two-dimensional array of pins 11 extend. Each pin 11 has the same length and other dimensions. Preferably, each pin 11 is spaced from each adjacent pin in the array by the same distance. The present inventor has adopted the term "pitch" for this spacing. The preferred pitch of the array is about 1 mm.

The pins 11 may have any suitable cross-sectional shape. The present inventor, when testing the invention, has used stainless steel pins having a circular cross-section, with a diameter of 0.53 mm and having a tapered point. (Such pins are supplied to the textile trade by retail and wholesale outlets.) However, in the currently preferred form of the present invention, the block 12 and the pins 11 are manufactured from a single slab of stainless steel, the pins being created using a thin diamond-impregnated wheel to cut grooves in a face of the steel slab. With this cutter, pins having square, hexagonal and octagonal cross-sections can be fabricated. A separate diamond-impregnated tool may be used to create a tapered point on each pin.

Although regular arrays of the pins 11 are preferred, the pins 11 may be arranged in a random two-dimensional sequence.

For special runs of dyed carpet tiles, in which a pattern or motif is to be printed on a small area (or on small areas) of the tile, the array of pins 11 need not extend over the entire front face of the block 12. Instead, a small array (or small arrays) of pins 11 may be positioned so that only the area of the pattern or motif applied to the carpet tile is heated by the pins, to fix the dye or dyes of the pattern or motif.

The block 12 shown in FIG. 1 of the accompanying drawings has a thin foil heating element 13 mounted on its back face 16. The heating element may be surrounded by a layer of insulation and then either clamped to the back face 16 or bonded to it. If the latter alternative is adopted, the adhesive used to bond the heating element to the face 16 (or to the surface of a groove formed in the face 16) may provide the required electrical insulation between the element 13 and the block 12. Preferably, (as indicated in FIG. 2) the heating element 13 is deposited as a thin film on an electrically insulating layer 19 positioned in a groove in the face 16 of the block 12, then covered with a similar layer of electrical insulation 19. A block or layer 21 of an electrically and thermally insulating material is preferably secured over the heating element 13. The layer 19 provides protection against damage (by contact) to the heating element 13; the block or layer 21 minimises heat loss from the back face 16 of the block 12.

To use the arrangement illustrated in FIG. 1, a carpet tile is positioned within the walls 14 of the housing 20, with the backing 17 (see FIG. 2) of the tile in contact with the base 15. The carpet tile contains liquid dye on (and within) the tufts 18 of the pile of the carpet tile. The heating element 13 is used to raise the temperature of the block 12 and the pins 11 to a value that will cause fixation of the dye on the pile of the carpet tile. This temperature will normally be in the range from 90° C. to 100° C., and is preferably about 95° C.

The pins 11 extending from the block 12 are then brought into contact with the dye-bearing pile of the carpet tile. As shown in FIG. 2, the pins penetrate the tufts 18 of the pile and (in the arrangement illustrated in FIG. 2) are positioned so that the points of the pins are adjacent to the backing 17 of the carpet tile. If the liquid dye is present only in the top portion of the tufts and has not reached that portion of the tufts which is adjacent to the backing 17, the pins need not penetrate the pile to the extent shown in FIG. 2.

The hot pins are held in contact with the dye liquor and with the pile tufts 18 for a time sufficient to increase the dye temperature to the fixation temperature and to fix the dye. This time varies according to the dye being used and the quantity of dye that has been deposited on the pile. Typically, the required contact time for the hot pins and the carpet tufts is 1 minute or thereabouts. The block 12 and the pins 11 may then be removed from the carpet tile.

It will be apparent that during the time that the dye is being fixed, the pile is within what is effectively a closed chamber, so that a high humidity is maintained throughout the fixation period. In addition, it will be apparent that during the fixation period, the conduction of heat from the pins will be predominantly into the liquid of the dye and little heat will be transferred to the pile of the carpet tile. Very little heat, therefore, will be conducted into the backing 17 of the carpet tile. Thus the backing 17 will remain relatively cool throughout the dye fixation period. This means that little heat is wasted in heating the backing 17 of the carpet tile and there is no risk of distortion of the backing 17 by heat (the risk of heat altering the dimensional stability of the backing of the tile is a matter for consideration if the backing is a bituminous material; there is little such risk if the backing is PVC based or has a similar composition). If it is felt necessary, the base 15 of the housing 20 may be mounted on a low temperature heat sink, to ensure that the temperature of the tile backing 17 is not increased to a potentially dangerous (as far as dimensional stability is concerned) level.

By way of further explanation of the present invention, it is well known that even metals which are poor thermal conductors have a thermal conductivity which is about one hundred times greater than that of water. It follows, therefore, that the temperature of the dye liquor in the surface pile will rise more rapidly when the array of pins, which have been previously heated to the desired temperature, is inserted into the pile than it will when heat is conducted through the liquor by the thermal conductivity of water in the pile. Normally, in the steam fixation processes, steam condensing on the surface will transfer energy to the pile surface and a substantial time will elapse while the temperature of the dye liquor rises to the steam temperature. Typically, for a carpet pile having a 200 percent moisture content based on the surface pile weight, it will take about three minutes to come to the equilibrium temperature and further time is then required to effect complete fixation of the dyestuff to the fibres.

When using the present invention, to achieve complete fixation of every element and feature of the print on a printed or dyed carpet tile, the element must be in contact with at least one heat conducting pin of the array of pins 11. Current carpet printing processes, especially current jet printing processes, can produce printed elements, or pixels, having sizes of the order of one millimeter. Often there is some spray or splash produced in the printing process, resulting in even smaller spots. Although there is a washing off operation, it is desirable that all of the dye in the deliberately printed area should be fixed and that the undesirable spots of dye are fixed as well. This indicates that the pitch of the array of heat conductors should be in the order of, and preferably less than, one millimeter, as indicated above.

Although, as noted above, it may not be essential, in every instance of dye fixation, for the pins 11 to fully penetrate the pile of the carpet tile to the backing to achieve uniform heating within the pile, it is necessary that they should be able to do so without the block 12 coming into contact with the top of the pile. It is an advantage if the pins have a pitch which is greater than the pin diameter, to allow full penetration of the pile by the pins without crushing down the pile.

Some degree of lateral compression of the pile can be tolerated and, in fact, is desirable to bring all of the print dye liquor into contact with the heat conducting pins and ensure fixation. The present inventor has found that, depending on the pile density, a compression of about one hundred percent is sufficient for this purpose. This is achieved by setting the pitch of the pins, relative to their diameter, so that the area of the interstices equals the total of the cross-sectional area of the pins, measured across the non-tapered part of the shank. The optimal ratio of space to conducting area can be determined empirically for a particular type of carpet tile using the following guidelines. The individual fibres cannot be compressed although the space between them may be reduced. Where the surface pile density is low, the ratio of interstitial space to conductor may be reduced, and conversely, where the surface pile density is high, this ratio may be increased.

The conducting pins must be chemically resistant to the print liquor and its chemical auxiliaries (such as pH control agents, antifoaming agents and the like). Because the fixation occurs at an elevated temperature, in excess of 90° C., and the chemical environment is aggressive, the material from which the pins are made is important. In some of the more benign environments, stainless steel pins will be adequate. However, when the invention is to be used in more corrosive environments, a more resistant metal, such as titanium, will be required for the pins.

Although the accompanying drawings and the foregoing description concerns a carpet tile fixation unit which is used to fix the dyestuff to the pile of the carpet tile in a one-by-one batch process, it will be clear that the present invention extends also to a continuous process in which the pins are mounted on a moving drum, or belt or the like, and heat is transferred on a continuous basis within a chamber closed from the atmosphere. Such an arrangement can be used to fix liquid dye on the pile of broadloom carpet, as well as on carpet tiles.

If, as foreshadowed earlier in this specification, the present invention is used to quickly remove heat from a medium, the basic modification that is required, to a block arranged as shown in FIGS. 1 and 2, is the replacement of the heating element 13 by a refrigerating or cooling element.

I claim:

1. A method of fixation of a liquid dye applied to the pile of a carpet tile consisting of a backing material with pile thereon, said method comprising the steps of:

(a) positioning the carpet tile within a housing having a base and side walls extending from said base, with the backing material of the tile in contact with said base;

(b) moving into the housing a block having a two-dimensional array of heated pins extending from a lower face thereof, until each pin of the array penetrates the pile of the carpet tile to a predetermined depth; and (c) transferring heat from the pins to raise the temperature of the dye on the pile to a temperature sufficient to fix the dye.

2. A method as defined in claim 1 in which said temperature is in the range from 90° C. to 100° C.

3. A method as defined in claim 2, in which said temperature is about 95° C.

4. A method as defined in claim 1, further comprising providing an effectively closed chamber upon moving said block into said housing thereby maintaining high humidity during the fixation of the dye.

5. Apparatus for fixation of liquid dye on a pile of a carpet tile consisting of a backing material with pile thereon, said apparatus comprising:

(a) a carpet tile receiving housing, said housing having a base and side walls extending therefrom;

(b) a thermally conducting block having an upper face and a lower face, said block having dimensions such that the block can be moved into said housing;

(c) a two-dimensional array of pins extending from the lower face of said block;

(d) a heating element either (i) located within said block or (ii) affixed to said upper face of said block; and (e) a layer of thermally insulating material mounted on said upper face.

6. Apparatus as defined in claim 5, in which said block is a metal block and said pins are metal pins.

7. Apparatus as defined in claim 6, in which said block and said pins are formed integrally from a single slab of metal.

8. Apparatus as defined in claim 6, in which said pins are of stainless steel or titanium.

9. Apparatus as defined in claim 5, in which the end of each pin in the array which is remote from said front face is tapered to a point.

10. Apparatus as defined in claim 5, in which said heating element comprises a thin film or metal foil heating element.

11. Apparatus as defined in claim 10, in which said thin film or metal foil heating element is surrounded by an electrically insulating material and is positioned within a groove formed in said upper face.

* * * * *